US008865382B2

(12) United States Patent
Nonaka et al.

(10) Patent No.: US 8,865,382 B2
(45) Date of Patent: Oct. 21, 2014

(54) ELECTROPHOTOGRAPHIC PHOTOSENSITIVE MEMBER, PROCESS CARTRIDGE AND ELECTROPHOTOGRAPHIC APPARATUS, AND PROCESS FOR PRODUCING ELECTROPHOTOGRAPHIC PHOTOSENSITIVE MEMBER

(75) Inventors: Masaki Nonaka, Suntou-gun (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 13/102,541

(22) Filed: May 6, 2011

(65) Prior Publication Data

US 2011/0300474 A1 Dec. 8, 2011

(30) Foreign Application Priority Data

Jun. 2, 2010 (JP) ..... 2010-126552
Apr. 25, 2011 (JP) ..... 2011-096915

(51) Int. Cl.

| | |
|---|---|
| ***G03G 15/00*** | (2006.01) |
| ***G03G 5/147*** | (2006.01) |
| ***G03G 5/05*** | (2006.01) |
| ***G03G 5/07*** | (2006.01) |
| ***G03G 5/06*** | (2006.01) |

(52) U.S. Cl.

CPC ..... *G03G 5/0609* (2013.01); *G03G 5/14791* (2013.01); *G03G 5/14795* (2013.01); *G03G 5/14786* (2013.01); *G03G 5/14734* (2013.01); *G03G 5/0542* (2013.01); *G03G 5/1473* (2013.01); *G03G 5/0546* (2013.01); *G03G 5/071* (2013.01)

USPC ..... 430/66; 430/56; 399/111; 399/159

(58) Field of Classification Search

USPC ..... 430/56, 66; 399/111, 159

See application file for complete search history.

(56) References Cited

U.S. PATENT DOCUMENTS

| | | | |
|---|---|---|---|
| 5,126,800 | A | 6/1992 | Shishido et al. |
| 5,208,634 | A | 5/1993 | Ikemoto et al. |
| 5,345,294 | A | 9/1994 | Nomura et al. |
| 5,623,328 | A | 4/1997 | Tsuda et al. |
| 5,828,928 | A | 10/1998 | Sasago et al. |
| 6,130,310 | A | 10/2000 | Katayama et al. |
| 6,465,143 | B2 | 10/2002 | Tanaka et al. |
| 7,071,962 | B2 | 7/2006 | Fujii et al. |
| 7,097,950 | B2 | 8/2006 | Tanaka et al. |

(Continued)

FOREIGN PATENT DOCUMENTS

| | | |
|---|---|---|
| JP | 4-174859 | 6/1992 |
| JP | 2003-302779 | * 10/2003 |
| JP | 2005148275 | 6/2005 |
| JP | 2006-58822 | * 3/2006 |

OTHER PUBLICATIONS

Machine translation of JP2003-302779.*
Machine Translation of JP2006-58822.*

(Continued)

*Primary Examiner* — Thorl Chea

(74) *Attorney, Agent, or Firm* — Fitzpatrick, Cella, Harper & Scinto

(57) ABSTRACT

An electrophotographic photosensitive member having a surface layer containing a polymeric product obtained by polymerizing a specific adamantane compound, a process cartridge and an electrophotographic apparatus which have the electrophotographic photosensitive member, and a process for producing the electrophotographic photosensitive member.

11 Claims, 2 Drawing Sheets

(56) References Cited

U.S. PATENT DOCUMENTS

| | | | | |
|---|---|---|---|---|
| 7,452,644 | B2 | 11/2008 | Tanaka et al. | |
| 2006/0122303 | A1 | 6/2006 | Li et al. | |
| 2011/0159419 | A1 * | 6/2011 | Iwamoto et al. | 430/56 |

OTHER PUBLICATIONS

Extended European Search Report in European Patent Application No. 11003999.7, dated Sep. 9, 2011.

Office Action in Chinese Patent Application No. 201110143918.8, mailed Jun. 1, 2012 (with English translation).

* cited by examiner

ELECTROPHOTOGRAPHIC PHOTOSENSITIVE MEMBER, PROCESS CARTRIDGE AND ELECTROPHOTOGRAPHIC APPARATUS, AND PROCESS FOR PRODUCING ELECTROPHOTOGRAPHIC PHOTOSENSITIVE MEMBER

BACKGROUND OF THE INVENTION

1. Field of the Invention

This invention relates to an electrophotographic photosensitive member, a process cartridge and an electrophotographic apparatus which have the electrophotographic photosensitive member, and a process for producing the electrophotographic photosensitive member.

2. Description of the Related Art

Electrophotographic photosensitive members making use of organic photoconductive materials (i.e., organic electrophotographic photosensitive members) have good film forming properties and can be produced by coating, and hence have advantages that they have a high productivity and can provide inexpensive electrophotographic photosensitive members. Accordingly, studies have hitherto widely been made thereon. In particular, for the purpose of making the electrophotographic photosensitive members have longer lifetimes and higher image quality, many attempts have been made until now in order to improve the electrophotographic photosensitive members in their scratch resistance and wear resistance.

Japanese Patent Application Laid-open No. H04-174859 discloses that an electrophotographic photosensitive member having a surface layer containing a polymeric product (high-molecular weight compound) having an adamantane structure has superior scratch resistance and wear resistance. Japanese Patent Application Laid-open No. 2003-302779 discloses that an electrophotographic photosensitive member having a surface layer containing a polymeric product (polymer) of a compound having a polymerizable functional group and an aliphatic hydrocarbon ring structure having 7 or more carbon atoms has superior wear resistance, where an adamantane structure is disclosed as an example of the aliphatic hydrocarbon ring structure having 7 or more carbon atoms.

However, under the existing conditions, there still is room for improvement about the scratch resistance and wear resistance of electrophotographic photosensitive members.

SUMMARY OF THE INVENTION

An object of the present invention is to provide an electrophotographic photosensitive member having superior scratch resistance and wear resistance, a process cartridge and an electrophotographic apparatus which have the electrophotographic photosensitive member, and also provide a process for producing the electrophotographic photosensitive member.

The present invention is an electrophotographic photosensitive member having a surface layer containing a polymeric product obtained by polymerizing an adamantane compound represented by the following general formula (1).

(1)

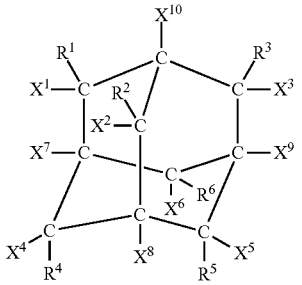

In the general formula (1), $R^1$ to $R^6$ each independently represent a hydrogen atom, an alkyl group, a haloalkyl group, a hydroxyl group, an alkoxyl group, an amino group, an alkylamino group, a trialkylsilyl group or a halogen atom; and $X^1$ to $X^{10}$ each independently represent a hydrogen atom, an alkyl group, a haloalkyl group, a hydroxyl group, an alkoxyl group, an amino group, an alkylamino group, a trialkylsilyl group, a halogen atom or an organic group having a chain polymerizable functional group; where $R^1$ and $X^1$ may combine to form an oxo group (=O), $R^2$ and $X^2$ may combine to form an oxo group (=O), $R^3$ and $X^3$ may combine to form an oxo group (=O), $R^4$ and $X^4$ may combine to form an oxo group (=O), $R^5$ and $X^5$ may combine to form an oxo group (=O) and $R^6$ and $X^6$ may combine to form an oxo group (=O), provided that at least two of $X^1$ to $X^{10}$ are organic groups having chain polymerizable functional groups, and, where $X^1$ is an organic group having a chain polymerizable functional group, $R^1$ is a hydrogen atom, where $X^2$ is an organic group having a chain polymerizable functional group, $R^2$ is a hydrogen atom, where $X^3$ is an organic group having a chain polymerizable functional group, $R^3$ is a hydrogen atom, where $X^4$ is an organic group having a chain polymerizable functional group, $R^4$ is a hydrogen atom, where $X^5$ is an organic group having a chain polymerizable functional group, $R^5$ is a hydrogen atom, and where $X^6$ is an organic group having a chain polymerizable functional group, $R^6$ is a hydrogen atom.

The present invention is also a process for producing the above electrophotographic photosensitive member, which is a process for producing an electrophotographic photosensitive member; the process having the step of forming the above surface layer by irradiating with radiations a coating formed by using a coating solution containing an adamantane compound represented by the above general formula (1), to polymerize the adamantane compound represented by the general formula (1).

The present invention is also a process cartridge which integrally supports the above electrophotographic photosensitive member and at least one means selected from the group consisting of a charging means, a developing means, a transfer means and a cleaning means, and is detachably mountable to the main body of an electrophotographic apparatus.

The present invention is also an electrophotographic apparatus having the above electrophotographic photosensitive member, a charging means, an exposure means, a developing means and a transfer means.

According to the present invention, it can provide an electrophotographic photosensitive member having superior scratch resistance and wear resistance, a process cartridge and an electrophotographic apparatus which have the electrophotographic photosensitive member, and also provide a process for producing the electrophotographic photosensitive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

About the mechanism by which the effect of the present invention is brought out, the present inventors presume it as stated below.

Among various aliphatic hydrocarbon ring structures, the adamantane structure is known to have a high hardness due to the highness of carbon density, and is expected to bring an improvement in hardness of the surface layer as long as it can be made uniformly present in the surface layer. However, studies made by the present inventors have revealed that, in the case of an adamantane compound having only one chain polymerizable functional group, adamantane structures can not completely be stopped from their mutual microscopic agglomeration, and this causes their non-uniform presence in the surface layer to make the electrophotographic photosensitive member unable to be sufficiently effectively improved in its scratch resistance. On the other hand, where the adamantane structure is made to have two or more chain polymerizable functional groups as in the present invention, the polymeric product of such a compound can be a polymeric product having a three-dimensional network structure. Then, the position of presence of adamantane structures in such a three-dimensional network structure is fixed by the combination of a plurality of chain polymerizable functional groups. As the result, the mutual microscopic agglomeration of adamantane structures can not easily takes place, so that the adamantane structures can be made uniformly present in the surface layer, as so presumed.

Either adamantane compounds disclosed in the above Japanese Patent Applications Laid-open No. H04-174859 and No. 2003-302779 are adamantane compounds having only one (chain) polymerizable functional group, and hence, as stated above, they cause the non-uniform presence of adamantane structures in the surface layer to make the electrophotographic photosensitive member unable to be sufficiently effectively improved in its scratch resistance.

The electrophotographic photosensitive member of the present invention commonly has a support and a photosensitive layer formed on the support.

Figure 1A:
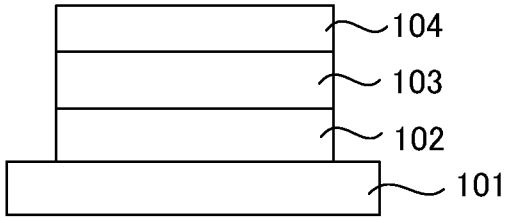
FIGS. 1A and 1B are views showing examples of the layer configuration of an electrophotographic photosensitive member.
Figure 1B:
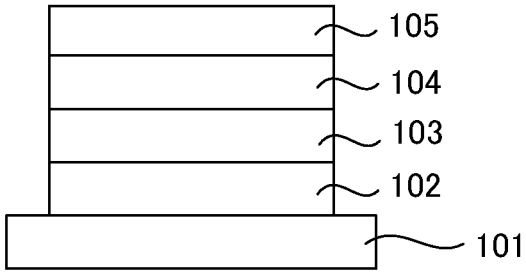

In the present invention, the photosensitive layer is a single-layer type photosensitive layer which contains a charge-transporting material and a charge-generating material in the same layer, or a multi-layer type photosensitive layer (FIGS. 1A and 1B) formed in layers separated functionally into a charge generation layer which contains a charge-generating material and a charge transport layer which contains a charge-transporting material. From the viewpoint of electrophotographic performance, the multi-layer type photosensitive layer is preferred. In FIGS. 1A and 1B, reference numeral 101 denotes the support; 102, a subbing layer; 103, the charge generation layer; 104, the charge transport layer; and 105, a protective layer. The subbing layer is also called an intermediate layer or a barrier layer.

In the present invention, the surface layer of the electrophotographic photosensitive member refers to a layer positioned at the outermost surface side of the electrophotographic photosensitive member. For example, in the case of the electrophotographic photosensitive member having the layer configuration shown in FIG. 1A, the surface layer of the electrophotographic photosensitive member is the charge transport layer 104. Also, in the case of the electrophotographic photosensitive member having the layer configuration shown in FIG. 1B, the surface layer of the electrophotographic photosensitive member is the protective layer 105.

In the present invention, the surface layer of the electrophotographic photosensitive member contains an adamantane compound represented by the following general formula (1).

(1)

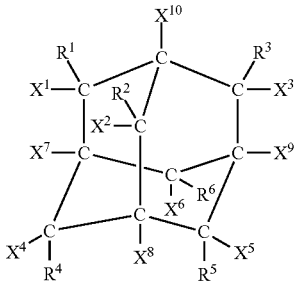

In the general formula (1), $R^1$ to $R^6$ each independently represent a hydrogen atom, an alkyl group, a haloalkyl group, a hydroxyl group, an alkoxyl group, an amino group, an alkylamino group, a trialkylsilyl group or a halogen atom. $X^1$ to $X^{10}$ each independently represent a hydrogen atom, an alkyl group, a haloalkyl group, a hydroxyl group, an alkoxyl group, an amino group, an alkylamino group, a trialkylsilyl group, a halogen atom or an organic group having a chain polymerizable functional group. Optionally, $R^1$ and $X^1$ may combine to form an oxo group (=O), $R^2$ and $X^2$ may combine to form an oxo group (=O), $R^3$ and $X^3$ may combine to form an oxo group (=O), $R^4$ and $X^4$ may combine to form an oxo group (=O), $R^5$ and $X^5$ may combine to form an oxo group (=O) and $R^6$ and $X^6$ may combine to form an oxo group (=O), provided that at least two of $X^1$ to $X^{10}$ are organic groups having chain polymerizable functional groups. Where $X^1$ is an organic group having a chain polymerizable functional group, $R^1$ is a hydrogen atom, where $X^2$ is an organic group having a chain polymerizable functional group, $R^2$ is a hydrogen atom, where $X^3$ is an organic group having a chain polymerizable functional group, $R^3$ is a hydrogen atom, where $X^4$ is an organic group having a chain polymerizable functional group, $R^4$ is a hydrogen atom, where $X^5$ is an organic group having a chain polymerizable functional group, $R^5$ is a hydrogen atom, and where $X^6$ is an organic group having a chain polymerizable functional group, $R^6$ is a hydrogen atom.

The alkyl group may include, e.g., a methyl group, an ethyl group, a propyl group (an n-propyl group or an isopropyl group) and a butyl group. The haloalkyl group (an alkyl group having a halogen atom as a substituent) may include, e.g., a trifluoromethyl group. The alkoxyl group may include, e.g., a methoxyl group and an ethoxyl group. The alkylamino group (an amino group having an alkyl group as a substituent) may include, e.g., a dimethylamino group and a diethylamino group. The trialkylsilyl group (a silyl group having three alkyl groups as a substituent) may include, e.g., a trimethylsilyl group, a triethylsilyl group, a tert-butyl dimethylsilyl group and a triisopropylsilyl group. The halogen atom may include, e.g., a fluorine atom, a chlorine atom and a bromine atom.

From the viewpoint of wear resistance, $X^1$ to $X^6$ and $R^1$ to $R^6$ may each preferably be a hydrogen atom or a fluorine atom. $X^7$ to $X^{10}$ may each preferably be a hydrogen atom, a hydroxyl group, a fluorine atom or an organic group having a chain polymerizable functional group, and at least two of $X^7$ to $X^{10}$ may preferably be organic groups having chain polymerizable functional groups. Further, $X^{10}$ may preferably be a hydrogen atom, a hydroxyl group; a fluorine atom or an organic group having a chain polymerizable functional group. It is much preferable that $X^7$ to $X^9$ are each a hydrogen atom, a fluorine atom or an organic group having a chain polymerizable functional group and at least two of $X^7$ to $X^9$ are organic groups having chain polymerizable functional groups.

The organic group having a chain polymerizable functional group may preferably be what is constituted of a chain polymerizable functional group which is a group that contributes to the reaction of forming a high-molecular product by chain polymerization and a divalent organic residual group that intervenes between the chain polymerizable functional group and an adamantane structure, or what does not have any divalent organic residual group and is constituted of a chain polymerizable functional group only.

The divalent organic residual group may include, e.g., an alkylene group and an arylene group. The alkylene group may include, e.g., a methylene group, an ethylene group, a propylene group, a butylene group, a pentylene group and a dimethyl methylene group. The arylene group may include, e.g., a phenylene group.

The chain polymerizable functional group refers to, e.g., as described in "BASIC CHEMISTRY OF SYNTHETIC RESINS (New Edition)" (published by GIHODO SHUPPAN Co., Ltd.), a group that contributes, as its form, to unsaturation polymerization or ring-opening polymerization the reaction of which proceeds chiefly by way of an intermediate such as radicals or ions.

The group that contributes to unsaturation polymerization may include, e.g., groups having structures such as —C═C, —C≡C, —C═O, —C═N and —C≡N.

Specific examples of such an unsaturation polymerizable functional group are shown below.

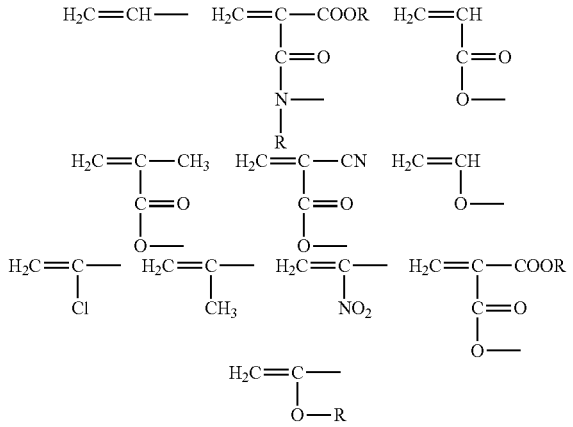

The above R represents a hydrogen atom, an alkyl group such as a methyl group, an ethyl group or a propyl group, an aralkyl group such as a benzyl group or a phenethyl group, or an aryl group such as a phenyl group, a naphthyl group or an anthryl group.

Of these, an acryloyloxyl group (the second from the top of the left column) and a methacryloyloxyl group (the third from the top of the left column) are preferred.

The group that contributes to ring-opening polymerization may include, e.g., groups having structures such as a carbon ring, an oxo ring and a nitrogen hetero ring. These are mostly those in which ions act as an active species.

Specific examples of such a ring-opening polymerizable functional group are shown below.

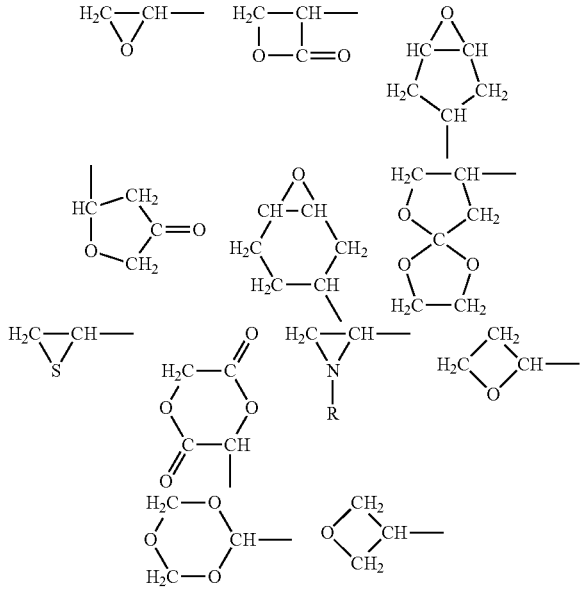

The above R represents a hydrogen atom, an alkyl group such as a methyl group, an ethyl group or a propyl group, an aralkyl group such as a benzyl group or a phenethyl group, or an aryl group such as a phenyl group, a naphthyl group or an anthryl group.

Of the group having the above chain polymerizable functional group, a group represented by the following general formula (2) is preferred.

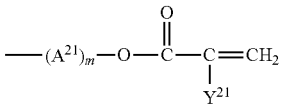

(2)

In the general formula (2), $A^{21}$ represents an alkylene group, m is an integer of 0 or 1, and $Y^{21}$ represents a hydrogen atom or a methyl group.

From the viewpoint of polymerization efficiency, m in the general formula (2) may preferably be 0, and $Y^{21}$ may preferably be a methyl group.

Of the compound represented by the general formula (1), a compound represented by the following general formula (3) or (4) is preferred.

(3)

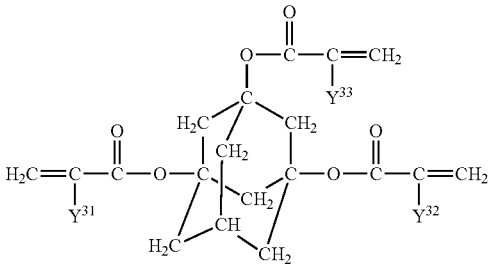

In the general formula (3), $Y^{31}$ to $Y^{33}$ each independently represent a hydrogen atom or a methyl group.

(4)

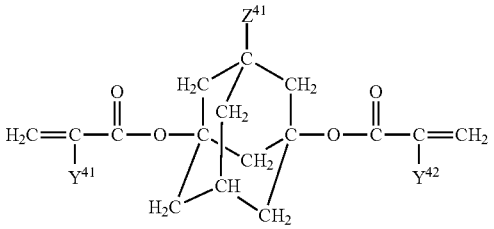

In the general formula (4), $Y^{41}$ and $Y^{42}$ each independently represent a hydrogen atom or a methyl group, and $Z^{41}$ represents a hydroxyl group.

Specific examples (Exemplary Compounds) of the compound represented by the general formula (1) are shown below.

(A-1)

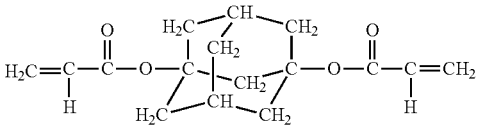

(A-2)

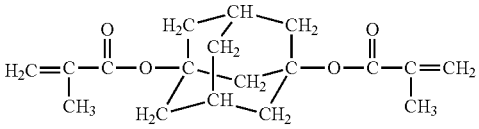

(A-3)

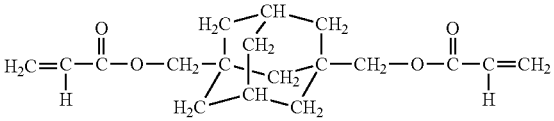

(A-4)

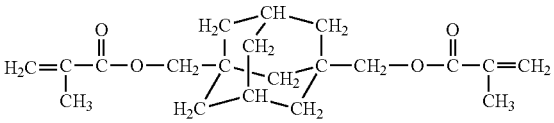

-continued (A-5)

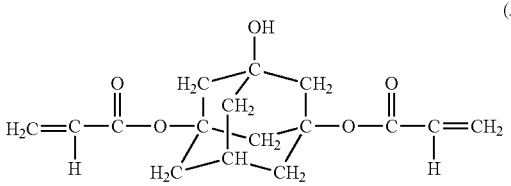

(A-6)

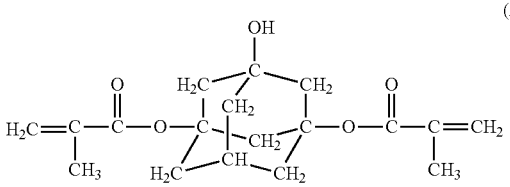

(A-7)

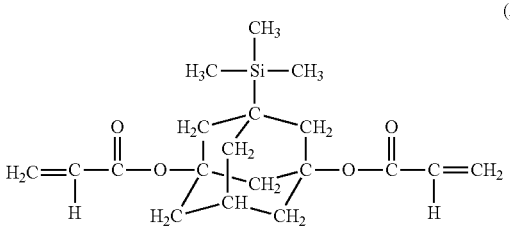

(A-8)

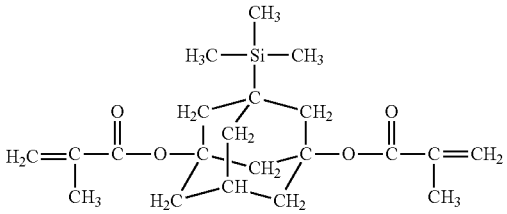

(A-9)

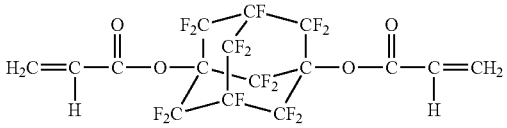

(A-10)

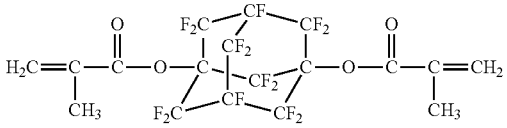

(A-11)

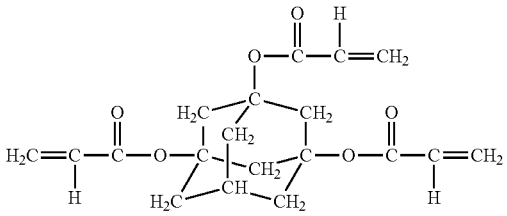

(A-12)

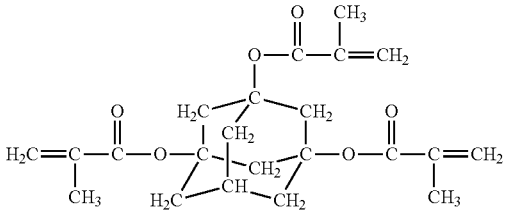

-continued (A-13)

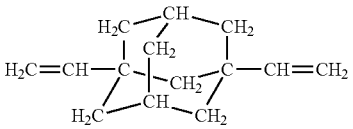

(A-14)

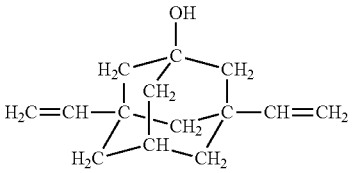

(A-15)

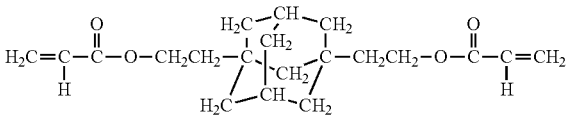

(A-16)

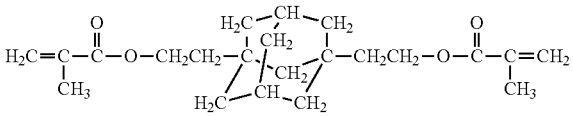

(A-17)

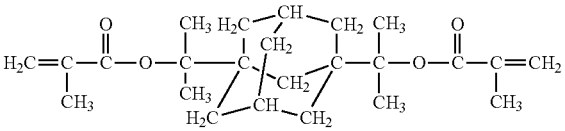

(A-18)

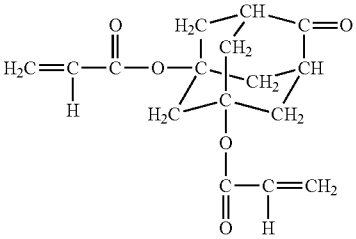

(A-19)

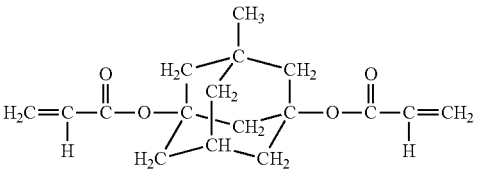

(A-20)

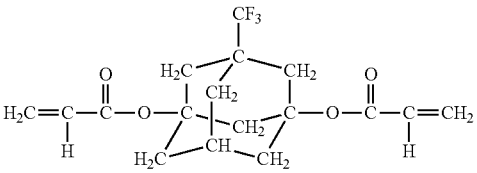

(A-21)

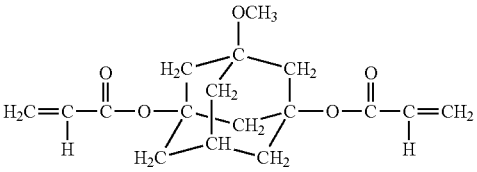

-continued (A-22)

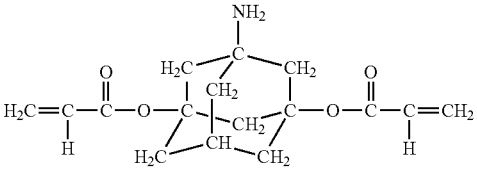

(A-23)

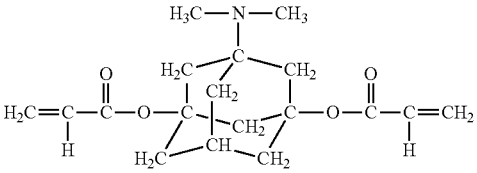

Of these, (A-5), (A-6), (A-11) and (A-12) are much preferred.

The compound represented by the general formula (1) may be used alone or may be used in combination of two or more types.

In the surface layer of the electrophotographic photosensitive member, besides the compound represented by the general formula (1), a compound having a chain polymerizable functional group but not included in the general formula (1) may also be used in combination. More specifically, the surface layer of the electrophotographic photosensitive member may be incorporated with a co-polymeric product obtained by copolymerizing the compound represented by the general formula (1) with the compound having a chain polymerizable functional group but not included in the general formula (1).

Stated specifically, the compound having a chain polymerizable functional group but not included in the general formula (1) may include, e.g., olefinic compounds (compounds having only one double bond C═C), halogenated olefinic compounds [compounds having only one double bond C═C and having a halogen X (X is F, Cl, Br or I)], diene compounds (compounds having two or more double bonds C═C), acetylene compounds (compounds having one or more triple bond(s) C≡C), styrene compounds [compounds having a structure of C═C—Ar (Ar is an aromatic ring or an aromatic heterocyclic ring)], vinyl compounds (compounds having a vinyl group C═C—), acrylic compounds [compounds having a structure of C═C—CO—Z (Z is O, S or N) or C═C—CN)], cyclic ether compounds (cyclic compounds having an —O— linkage in the ring), lactone compounds (cyclic compounds having a —CO—O— linkage in the ring), lactam compounds (cyclic compounds having an —NH—CO— linkage in the ring), cyclic amine compounds (cyclic compounds having an —NH— linkage in the ring), cyclic sulfide compounds (cyclic compounds having an S atom in the ring), cyclic carbonate compounds (cyclic compounds having an —O—CO—O— linkage in the ring), cyclic acid anhydrides (cyclic compounds having a —CO—O—CO— linkage in the ring), cyclic imino ether compounds (cyclic compounds having an —N═C—O— linkage in the ring), amino acid-N-carboxylic anhydrides (cyclic compounds having an —O—CO—N═C—CO— linkage in the ring), cyclic imide compounds (cyclic compounds having a —CO—NH—CO— linkage, an —NH—CO—O— linkage or an —NH—CO—NH— linkage in the ring), cyclic phosphorus-containing compounds (cyclic compounds having a P atom in the ring), cyclic silicon-containing compounds (cyclic compounds having an Si atom in the ring), cyclic olefinic compounds (cyclic compounds the ring of which is formed of carbon or a carbon multiple bond), phenolic compounds (compounds having an aromatic hydroxyl structure), melamine-urea compounds (melamines or urea derivatives), diamine compounds (inclusive of diamine derivatives and polyamine), dicarboxylic acid compounds (dicarboxylic acid (ester) derivatives), hydroxycarboxylic acid compounds (hydroxycarboxylic acid (ester) derivatives), aminocarboxylic acid compounds (aminocarboxylic acid (ester) derivatives), diol compounds (polyols having two or more free OH groups), diisocyanate compounds (iso(thio)cyanate derivatives), sulfur-containing compounds (sulfur(S)-containing monomers), phosphorus-containing compounds (phosphorus (P)-containing monomers), aromatic ether compounds (compounds the aliphatic hydrocarbon groups of which have mutually been linked with an oxygen atom(s), dihalogen compounds (compounds having a plurality of carbon-halogen bonds other than acid halides), aldehyde compounds (compounds having an aldehyde group), diketone compounds, carbonate derivative compounds, aniline derivative compounds, and silicon compounds.

From the viewpoint of electrical properties, the compound having a chain polymerizable functional group but not included in the general formula (1) may preferably be a charge-transporting compound having a charge-transporting structure in the molecule. Such a charge-transporting structure may include, e.g., structures such as triarylamine, hydrazone, pyrazoline and carbazole. Of the charge-transporting compound, a hole-transporting compound is preferred from the viewpoint of electrical properties.

From the viewpoint of polymerization efficiency, the chain polymerizable functional group may preferably be an acryloyloxyl group or a methacryloyloxyl group.

Further, from the viewpoint of forming a sufficient three-dimensional network structure in the surface layer of the electrophotographic photosensitive member, such a charge-transporting compound having a chain polymerizable functional group may preferably be a charge-transporting compound having two or more chain polymerizable functional groups.

When the adamantane compound represented by the general formula (1) and the other compound(s) having a chain polymerizable functional group(s) are polymerized, a polymerization initiator may optionally be used. These compounds may also be polymerized by using heat, light (such as ultraviolet rays) and/or radiations (such as electron rays). Of these, the polymerization initiator need not necessarily be used, which has a possibility of making electrophotographic performance poor. Polymerization making use of radiations is preferred, and polymerization making use of electron rays is much preferred, as being not easily affected by any shielding effect of various kinds of fillers or the like. Also, where the compound(s) having a chain polymerizable functional group(s) is/are polymerized, for the purpose of removing any polymerization inhibitory action caused by oxygen, it is preferable to irradiate the compound(s) with electron rays in an atmosphere of an inert gas and thereafter heat the same in an atmosphere of an inert gas. The inert gas may include, e.g., nitrogen and argon.

As the support of the electrophotographic photosensitive member, it may preferably be one having conductivity (conductive support). It may include, e.g., supports made of a metal such as aluminum, stainless steel or nickel, and supports made of metal, plastic or paper the surface of which is provided thereon with a conductive film. As the shape of the support, it may include, e.g., a cylinder shape and a film shape. Of these, a cylinder-shaped support made of aluminum is advantageous in view of mechanical strength, electrophotographic performance and cost.

An unprocessed aluminum pipe as such may also be used as the support. Instead, one obtained by subjecting the surface of an unprocessed aluminum pipe to physical processing such as cutting or honing, or anodizing or chemical processing making use of an acid, may also be used as the support. A support having been so processed as to have a surface roughness of from 0.1 μm or more to 3.0 μm or less as Rz value by carrying out the physical processing such as cutting or honing on the unprocessed aluminum pipe has an excellent interference fringe preventive function.

A conductive layer (not shown in FIGS. 1A and 1B) may optionally be provided between the support and the photosensitive layer or a subbing layer described later. The conductive layer need not necessarily be used where the support itself has been provided with the interference fringe preventive function. Where, however, the unprocessed aluminum pipe as such is used as the support and the conductive layer is formed thereon, the support can be provided with the interference fringe preventive function by such a simple method. Hence, this is very useful in view of productivity and cost.

The conductive layer may be formed by i) coating on the support a conductive layer coating dispersion prepared by dispersing inorganic particles of tin oxide, indium oxide, titanium oxide, barium sulfate or the like in a suitable solvent together with a curable resin such as phenol resin and optionally adding roughening particles thereto, and ii) thereafter drying by heating, the wet coating formed.

The conductive layer may preferably have a layer thickness of from 10 μm or more to 30 μm or less, from the viewpoint of the interference fringe preventive function and the covering of any defects of the support surface.

A subbing layer may be provided on the support or conductive layer for the purposes of securing adhesion to the support, protecting the photosensitive layer from its electrical breakdown, improving the injection of carriers into the photosensitive layer, and so forth.

The subbing layer may be formed by coating on the support or conductive layer a subbing layer coating solution obtained by dissolving a resin in a solvent, and drying the wet coating thus formed.

The resin used for the subbing layer may include, e.g., agarose resin, acrylic resin, allyl resin, alkyd resin, ethyl cellulose resin, an ethylene-acrylic acid copolymer, epoxy resin, casein resin, silicone resin, gelatin resin, cellulose resin, phenol resin, butyral resin, polyacrylate, polyacetal, polyamide-imide, polyamide, polyallyl ether, polyimide, polyurethane, polyester, polyethylene, polycarbonate, polystyrene, polysulfone, polyvinyl alcohol, polybutadiene, polypropylene, and urea resin.

The solvent used for the subbing layer coating solution may include, e.g., benzene, toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethyl formamide, dimethyl acetamide and dimethyl sulfoxide.

The subbing layer may preferably have a layer thickness of from 0.1 μm or more to 5 μm or less.

The photosensitive layer is provided on the support, on the conductive layer or on the subbing layer.

In the case when the photosensitive layer is the multi-layer type photosensitive layer, the charge generation layer may be formed by coating a charge generation layer coating dispersion containing a charge-generating material and optionally a binder resin, and drying the wet coating formed. The charge generation layer coating dispersion may be prepared by adding only a charge-generating material to a solvent to carry out dispersion treatment and thereafter adding a binder resin, or may be prepared by adding a charge-generating material to a solvent together with a binder resin to carry out dispersion treatment.

The charge-generating material may include, e.g., monoazo, bisazo, trisazo, tetrakisazo and the like azo pigments, phthalocyanine pigments such as gallium phthalocyanine and oxytitanium phthalocyanine, and perylene pigments. Of these, gallium phthalocyanine is preferred from the viewpoint of performance stability during any environmental variations. Further, from the viewpoint of high sensitivity, hydroxygallium phthalocyanine is preferred, and hydroxygallium phthalocyanine crystals with a crystal form having strong peaks at 7.4°±0.3° and 28.2°±0.3° of the Bragg's angle 2θ in CuKα characteristic X-ray diffraction is much preferred.

The binder resin used to form the charge generation layer may include, e.g., insulating resins such as polyvinyl butyral, polyarylate, polycarbonate, polyester, phenoxy resin, polyvinyl acetate, acrylic resin, polyacrylamide, polyvinyl pyridine, cellulose resin, urethane resin, epoxy resin, agarose resin, casein resin, polyvinyl alcohol and polyvinyl pyrrolidone. An organic photoconductive polymer may also be used, such as poly-N-carbazole, polyvinyl anthracene or polyvinyl pyrene.

The solvent used for the charge generation layer coating dispersion may include, e.g., toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethyl formamide, dimethyl acetamide and dimethyl sulfoxide.

The charge generation layer may preferably have a layer thickness of from 0.05 μm or more to 5 μm or less.

In the case when the photosensitive layer is the multi-layer type photosensitive layer, the charge transport layer may be formed by coating a charge transport layer coating solution obtained by dissolving a charge-transporting material and optionally a binder resin in a solvent, and drying the wet coating formed.

The charge-transporting material may include, e.g., triarylamine compounds, hydrazone compounds, stilbene compounds, pyrazoline compounds, oxazole compounds, thiazole compounds and triarylmethane compounds.

The binder resin used to form the charge transport layer may include, e.g., insulating resins such as polyvinyl butyral, polyarylate, polycarbonate, polyester, phenoxy resin, polyvinyl acetate, acrylic resin, polyacrylamide resin, polyamide resin, polyvinyl pyridine resin, cellulose resin, urethane resin, epoxy resin, agarose resin, casein resin, polyvinyl alcohol and polyvinyl pyrrolidone. An organic photoconductive polymer may also be used, such as poly-N-carbazole, polyvinyl anthracene or polyvinyl pyrene.

The solvent used for the charge transport layer coating solution may include, e.g., toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethyl formamide, dimethyl acetamide and dimethyl sulfoxide.

The charge transport layer may preferably have a layer thickness of from 5 μm or more to 40 μm or less.

The surface layer may be formed by coating a surface layer coating solution prepared by dissolving in a solvent at least the adamantane compound represented by the general formula (1), and heating and/or irradiating with radiations the coating formed, to polymerize the adamantane compound.

The solvent used for the surface layer coating solution may include, e.g., toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, 1,1,2,2,3,3,4-heptafluorocyclopentane, N,N'-dimethylcyclohexylamine, methyl cellosolve, methoxypropanol, dimethyl formamide, dimethyl acetamide and dimethyl sulfoxide.

The surface layer of the electrophotographic photosensitive member of the present invention is made up as described above. Further, the surface layer may also be incorporated therein with conductive particles, an ultraviolet absorber and a wear resistance improver. The conductive particles may include, e.g., metal oxide particles such as tin oxide particles. The wear resistance improver may include, e.g., fluorine atom-containing resin particles, alumina particles and silica particles.

The surface layer may preferably have a layer thickness of from 0.5 μm or more to 20 μm or less.

In the case when the electrophotographic photosensitive member has the layer configuration shown in FIG. 1A, the above surface layer, having been made to have charge transport ability, is formed on the charge generation layer as the charge transport layer. In the case when it has the layer configuration shown in FIG. 1B, the surface layer is formed on the charge transport layer.

In forming the above respective layers, any of coating methods such as dip coating (dipping), spray coating, spinner coating, bead coating, blade coating and beam coating may be used.

Figure 2:
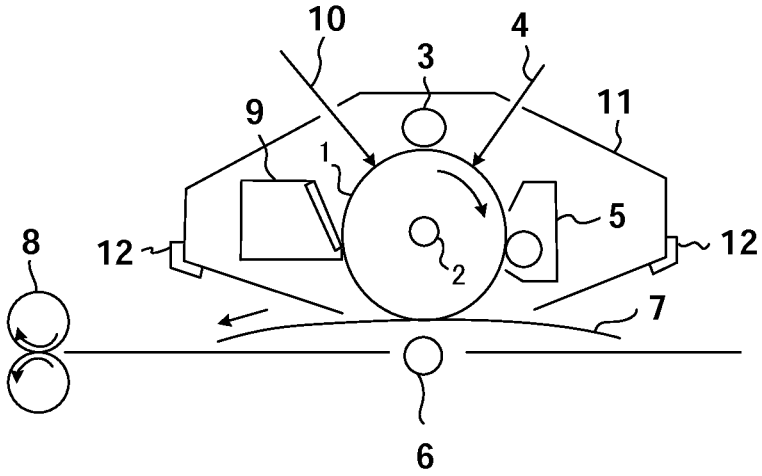
FIG. 2 is a view showing schematically an example of the construction of an electrophotographic apparatus provided with a process cartridge having the electrophotographic photosensitive member of the present invention.

An example of the construction of an electrophotographic apparatus provided with a process cartridge having the electrophotographic photosensitive member of the present invention is schematically shown in FIG. 2.

In FIG. 2, reference numeral 1 denotes a drum-shaped electrophotographic photosensitive member of the present invention, which is rotatingly driven around an axis 2 in the direction of an arrow at a given peripheral speed (process speed). In the course of rotation, the electrophotographic photosensitive member 1 is electrostatically charged on its peripheral surface to a positive or negative, given potential through a charging means (primary charging means) 3. Then, the surface of the electrophotographic photosensitive member is exposed to imagewise exposure light 4 emitted from an exposure means (not shown) and having been intensity-modulated correspondingly to time-sequential digital image signals of the intended image information. In this way, electrostatic latent images corresponding to the intended image information are successively formed on the surface of the electrophotographic photosensitive member 1.

The electrostatic latent images thus formed thereon are subsequently rendered visible as toner images by regular development or reverse development with a toner held in a developing means 5. The toner images thus formed and held on the surface of the electrophotographic photosensitive member 1 are then successively transferred by a transfer means 6 to a transfer material 7. Here, the transfer material 7 is taken out of a paper feed section (not shown) in the manner synchronized with the rotation of the electrophotographic photosensitive member 1, and fed to the part between the electrophotographic photosensitive member 1 and the transfer means 6. Also, bias voltage having a polarity reverse to that of the electric charges the toner has is applied to the transfer means 6 from a bias power source (not shown). The transfer means may also be a transfer means of an intermediate transfer system having a primary transfer member, an intermediate transfer member and a secondary transfer member.

The transfer material 7 to which the toner images have been transferred is separated from the surface of the electrophotographic photosensitive member 1, and is transported to an image fixing means 8, where the toner images on the transfer material 7 are processed to be fixed, and is then delivered out of the electrophotographic apparatus as an image-formed material (a print or a copy).

The surface of the electrophotographic photosensitive member 1 from which the toner images have been transferred is brought to removal of any deposits such as transfer residual toner, through a cleaning means 9 and is made to have a clean surface. The transfer residual toner may also be collected with a developing assembly or the like. Further, the surface of the electrophotographic photosensitive member 1 is subjected to charge elimination by pre-exposure light 10 emitted from a pre-exposure means (not shown), and thereafter repeatedly used for the formation of images. Incidentally, where the charging means 3 is a contact charging means making use of a charging roller, such pre-exposure need not necessarily be required.

In the present invention, some constituents among constituents such as the electrophotographic photosensitive member 1, the charging means 3, the developing means 5, the transfer means 6 and the cleaning means 9 may be so received in a container as to be integrally supported to form a process cartridge. This process cartridge may also be so set up as to be detachably mountable to the main body of an electrophotographic apparatus such as a copying machine or a laser beam printer. For example, at least one means selected from the charging means 3, the developing means 5, the transfer means 6 and the cleaning means 9 may integrally be supported together with the electrophotographic photosensitive member 1 to form a cartridge to set up a process cartridge 11 detachably mountable to the main body of the electrophotographic apparatus through a guide means 12 such as rails provided in the main body of the electrophotographic apparatus.

EXAMPLES

The present invention is described below in greater detail by giving specific working examples. The present invention, however, is by no means limited to these. In the following working examples, "part(s)" refers to "part(s) by mass".

Example 1

50 parts of titanium oxide particles coated with tin oxide containing 10% by mass of antimony oxide, 25 parts of resol type phenolic resin, 20 parts of 1-methoxy-2-propanol, 5 parts of methanol and 0.002 part of silicone oil (a polydimethylsiloxane-polyoxyalkylene copolymer; weight average molecular weight: 3,000) were put into a sand mill making use of glass beads of 0.8 mm in diameter, and put to dispersion treatment for 2 hours to prepare a conductive layer coating dispersion.

This conductive layer coating dispersion was dip-coated on an aluminum cylinder (30 mm in outer diameter and 370 mm in length; a drawn pipe) used as a support, and then the wet coating formed was dried at 140° C. for 40 minutes to form a conductive layer with a layer thickness of 20 μm.

Next, 2.5 parts of a 6-66-610-12 nylon quadripolymer (trade name: AMILAN CM8000; available from Toray Industries, Inc.) and 7.5 parts of N-methoxymethylated nylon resin (trade name: TORESIN EF-30T; available from Nagase ChemteX Corporation) were dissolved in a mixed solvent of 100 parts of methanol and 90 parts of butanol to prepare a subbing layer coating solution.

This subbing layer coating solution was dip-coated on the conductive layer, and then the wet coating formed was dried at 100° C. for 10 minutes to form a subbing layer with a layer thickness of 0.8 μm.

Next, 11 parts of hydroxygallium phthalocyanine crystals (charge-generating material) with a crystal form having peaks at 7.4° and 28.2° of the Bragg's angle 2θ±0.2° in CuKα characteristic X-ray diffraction was added to a solution obtained by dissolving 5 parts of polyvinyl butyral resin (trade name: S-LEC BX-1; available from Sekisui Chemical Co., Ltd.) in 250 parts of cyclohexanone. To the mixture obtained, 500 parts of glass beads of 1 mm in diameter were added to carry out dispersion treatment for 2 hour under conditions of 1,800 rpm while being cooled with 19° C. cooling water. To the dispersion obtained as a result of the dispersion treatment, 300 parts of ethyl acetate and 160 parts of cyclohexanone were added to dilute it to prepare a charge generation layer coating dispersion.

Average particle diameter (median) of the hydroxygallium phthalocyanine crystals in this charge generation layer coating dispersion was measured with a centrifugal particle size measuring instrument (trade name: CAPA700) manufactured by Horiba, Ltd., operated by liquid-phase sedimentation as a basis, to find that it was 0.22 μm.

This charge generation layer coating dispersion was dip-coated on the subbing layer, and then the wet coating formed was dried at 110° C. for 10 minutes to form a charge generation layer with a layer thickness of 0.15 μm.

Next, 5 parts of a compound (charge-transporting material) represented by the following structural formula (5):

(5)

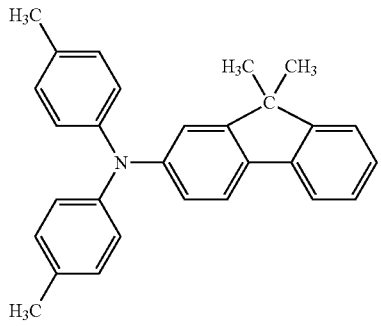

5 parts a compound (charge-transporting material) represented by the following structural formula (6):

(6)

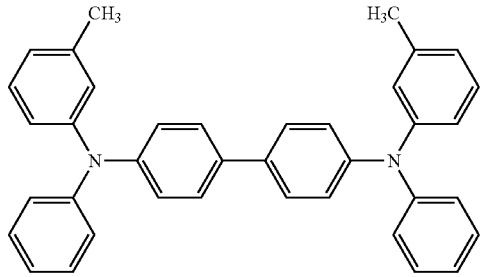

and 10 parts of polycarbonate (trade name: IUPILON Z400; available from Mitsubishi Gas Chemical Company, Inc.) were dissolved in a mixed solvent of 70 parts of monochlorobenzene and 30 parts of dimethoxymethane to prepare a charge transport layer coating solution.

This charge transport layer coating solution was dip-coated on the charge generation layer, and then the wet coating formed was dried at 95° C. for 30 minutes to form a charge transport layer with a layer thickness of 20 μm.

Next, 15 parts of Exemplary Compound (A-6) and 35 parts of a compound represented by the following formula (7):

(7)

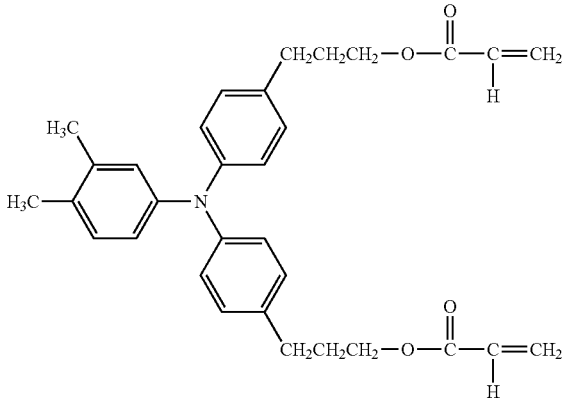

were dissolved in 25 parts of n-propanol, and further 25 parts of 1,1,2,2,3,3,4-heptafluorocyclopentane (trade name: ZEOROLA H, available from Nippon Zeon Co., Ltd.) was added thereto to prepare a protective layer coating solution.

This protective layer coating solution was dip-coated on the charge transport layer, and then the wet coating formed was treated by heating at 50° C. for 6 minutes. Thereafter, the coating formed was irradiated with electron rays for 1.5 seconds in an atmosphere of nitrogen and under conditions of an accelerating voltage of 80 kV and an absorbed dose of 22,000 Gy. Subsequently, the resultant coating was treated by heating at 130° C. for 40 seconds in an atmosphere of nitrogen. Here, oxygen concentration measured through a period of from the irradiation with electron rays to the heat treatment for 40 seconds was found to be 18 ppm. Next, this coating was treated by heating at 100° C. for 20 minutes in the atmosphere to form a protective layer with a layer thickness of 5.5 μm.

Thus, an electrophotographic photosensitive member was produced (manufactured), having the support and provided thereon the conductive layer, the subbing layer, the charge generation layer, the charge transport layer and the protective layer, the protective layer of which was the surface layer. This electrophotographic photosensitive member is designated as an electrophotographic photosensitive member 1.

Examples 2 to 9

Electrophotographic photosensitive members were produced in the same way as in Example 1 except that, in Example 1, Exemplary Compound (A-6) was changed for Exemplary Compounds (A-5), (A-11), (A-12), (A-1), (A-2), (A-4), (A-14) and (A-7), respectively. These are designated as electrophotographic photosensitive members 2 to 9, respectively.

Example 10

An electrophotographic photosensitive member was produced in the same way as in Example 1 except that the protective layer coating solution was prepared in the following way. This is designated as an electrophotographic photosensitive member 10.

15 parts of Exemplary Compound (A-6) and 35 parts of a compound represented by the following formula (8):

(8)

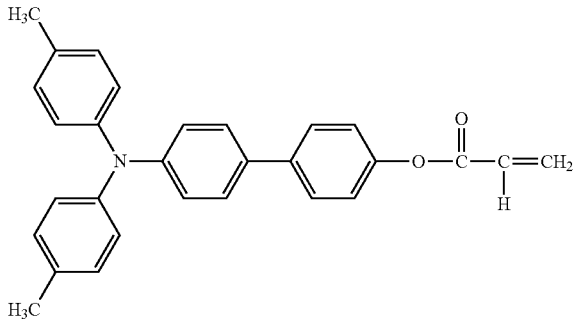

and 1 part of 1-hydroxy-cyclohexyl phenyl ketone (trade name: IRGACURE 184, available from Ciba Specialty Chemicals Inc.) were dissolved in 25 parts of n-propanol, and further 25 parts of 1,1,2,2,3,3,4-heptafluorocyclopentane (trade name: ZEOROLA H, available from Nippon Zeon Co., Ltd.) was added thereto to prepare a protective layer coating solution.

Example 11

An electrophotographic photosensitive member was produced in the same way as in Example 1 except that the protective layer coating solution was prepared in the following way. This is designated as an electrophotographic photosensitive member 11.

15 parts of Exemplary Compound (A-6), 17.5 parts of dipentaerythritol hexaacrylate (trade name: DPHA, available from Daicel-Cytec Company Ltd.) (a compound having a chain polymerizable functional group acryloyloxyl group and not having any charge transport structure), 17.5 parts of the compound represented by the formula (8) and 1 part of 1-hydroxy-cyclohexyl phenyl ketone (trade name: IRGACURE 184, available from Ciba Specialty Chemicals Inc.) (a polymerization initiator) were dissolved in 25 parts of n-propanol, and further 25 parts of 1,1,2,2,3,3,4-heptafluorocyclopentane (trade name: ZEOROLA H, available from Nippon Zeon Co., Ltd.) was added thereto to prepare a protective layer coating solution.

Example 12

An electrophotographic photosensitive member was produced in the same way as in Example 1 except that the protective layer was formed in the following way. This is designated as an electrophotographic photosensitive member 12.

50 parts of antimony-doped ultrafine tin oxide particles (treatment level: 6%) the surfaces of which were coated with a compound represented by the following formula (9):

(9)

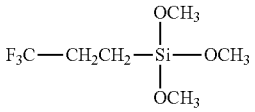

and 150 parts of ethanol were put into a sand mill to carry out dispersion treatment for 60 hours, and further 20 parts of polytetrafluoroethylene particles (average particle diameter: 0.18 μm) were added thereto to carry out dispersion treatment for 2 hours to obtain a fluid dispersion. Thereafter, to this fluid dispersion, 25 parts of Exemplary Compound (A-6) was added to prepare a protective layer coating solution.

This protective layer coating solution was dip-coated on the charge transport layer, and then the wet coating formed was treated by heating at 150° C. for 6 minutes to form a protective layer with a layer thickness of 5.5 μm.

Example 13

An electrophotographic photosensitive member was produced in the same way as in Example 1 except that the protective layer was formed in the following way. This is designated as an electrophotographic photosensitive member 13.

15 parts of Exemplary Compound (A-6), 17.5 parts of dipentaerythritol hexaacrylate (trade name: DPHA, available from Daicel-Cytec Company Ltd.) (a compound having a chain polymerizable functional group acryloyloxyl group and not having any charge transport structure), 17.5 parts of the compound represented by the formula (8) and 1 part of 1-hydroxy-cyclohexyl phenyl ketone (trade name: IRGACURE 184, available from Ciba Specialty Chemicals Inc.) (a polymerization initiator) were dissolved in 25 parts of n-propanol, and further 25 parts of 1,1,2,2,3,3,4-heptafluorocyclopentane (trade name: ZEOROLA H, available from Nippon Zeon Co., Ltd.) was added thereto to prepare a protective layer coating solution.

This protective layer coating solution was dip-coated on the charge transport layer, and then the wet coating formed was treated by heating at 50° C. for 6 minutes. Thereafter, the coating formed was irradiated with light for 25 seconds by using a metal halide lamp and under conditions of an irradiation intensity of 500 mW/cm$^2$. Thereafter, the resultant coating was treated by heating at 130° C. for 40 minutes to form a protective layer with a layer thickness of 5.5 μm.

Example 14

An electrophotographic photosensitive member was produced in the same way as in Example 1 except that, in Example 1, Exemplary Compound (A-6) was changed for Exemplary Compound (A-18). This is designated as an electrophotographic photosensitive member 14.

Comparative Examples 1 to 6

Electrophotographic photosensitive members were produced in the same way as in Example 1 except that, in Example 1, Exemplary Compound (A-6) was changed for a compound represented by the following formula (10), a compound represented by the following formula (11), a compound represented by the following formula (12), a compound represented by the following formula (13), a compound represented by the following formula (14) and a compound represented by the following formula (15), respectively. These are designated as electrophotographic photosensitive members C1 to C6, respectively.

(10)

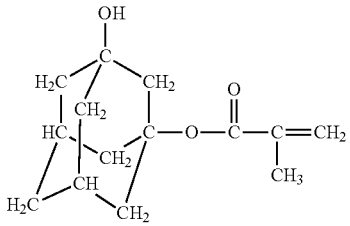

(11)

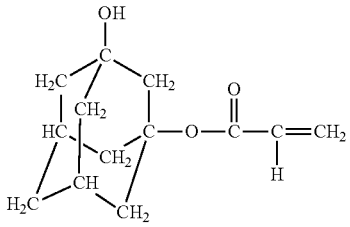

(12)

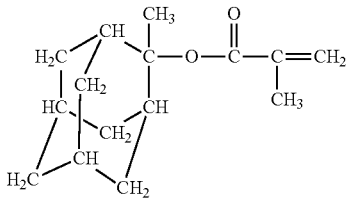

(13)

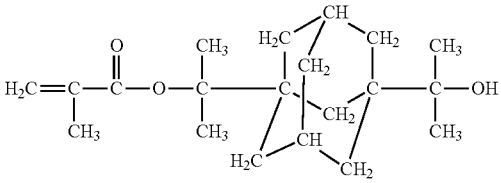

(14)

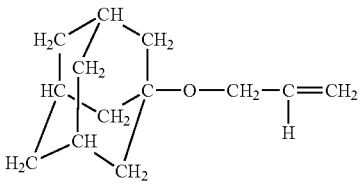

-continued (15)

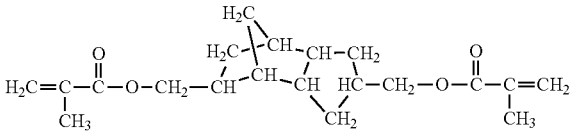

Comparative Example 7

An electrophotographic photosensitive member was produced in the same way as in Example 1 except that, in Example 1, Exemplary Compound (A-6) was not used. This is designated as an electrophotographic photosensitive member C7.

Comparative Example 8

An electrophotographic photosensitive member was produced in the same way as in Example 10 except that, in Example 10, Exemplary Compound (A-6) was not used. This is designated as an electrophotographic photosensitive member C8.

Comparative Example 9

An electrophotographic photosensitive member was produced in the same way as in Example 11 except that, in Example 11, Exemplary Compound (A-6) was not used. This is designated as an electrophotographic photosensitive member C9.

Comparative Example 10

An electrophotographic photosensitive member was produced in the same way as in Example 12 except that, in Example 12, Exemplary Compound (A-6) was changed for the compound represented by the above formula (10). This is designated as an electrophotographic photosensitive member C10.

Comparative Example 11

An electrophotographic photosensitive member was produced in the same way as in Example 13 except that, in Example 13, Exemplary Compound (A-6) was not used. This is designated as an electrophotographic photosensitive member C11.

Paper Feed Running Evaluation:

The electrophotographic photosensitive members 1 to 14 and C1 to C11 were each set in a copying machine of an electrophotographic system (trade name: iR4570), manufactured by CANON, INC., and a 400,000-sheet paper feed running test was conducted in an environment of 27° C./75% RH and setting its dark-area potential at −750 V and light-area potential at −160 V. On that occasion, the depth of wear (μm) of the surface layer after 50,000-sheet paper feed was examined. Further, whether or not any image defects caused by scratches occurring on the surface of the electrophotographic photosensitive member (i.e., scratch images) were seen was visually examined at intervals of 10,000-sheet paper feed.

The results are shown in Table 1.

TABLE 1

| | Electro-photographic photosensitive member | Paper feed running evaluation: Occurrence of scratch images | Paper feed running evaluation: Depth of wear of surface layer after 50,000-sheet paper feed (μm) |
|---|---|---|---|
| | | Example: | |
| 1 | 1 | No scratch image occurs even on feed of 400,000 sheets | 0.05 |
| 2 | 2 | No scratch image occurs even on feed of 400,000 sheets | 0.05 |
| 3 | 3 | No scratch image occurs even on feed of 400,000 sheets | 0.05 |
| 4 | 4 | No scratch image occurs even on feed of 400,000 sheets | 0.05 |
| 5 | 5 | No scratch image occurs even on feed of 400,000 sheets | 0.05 |
| 6 | 6 | No scratch image occurs even on feed of 400,000 sheets | 0.05 |
| 7 | 7 | Scratch images occur on feed of 300,000 sheets | 0.05 |
| 8 | 8 | Scratch images occur on feed of 250,000 sheets | 0.05 |
| 9 | 9 | No scratch image occurs even on feed of 400,000 sheets | 0.15 |
| 10 | 10 | Scratch images occur on feed of 350,000 sheets | 0.05 |
| 11 | 11 | Scratch images occur on feed of 380,000 sheets | 0.05 |
| 12 | 12 | Scratch images occur on feed of 330,000 sheets | 0.05 |
| 13 | 13 | Scratch images occur on feed of 250,000 sheets | 0.05 |
| 14 | 14 | No scratch image occurs even on feed of 400,000 sheets | 0.05 |
| | | Comparative Example: | |
| 1 | C1 | Scratch images occur on feed of 150,000 sheets | 0.20 |
| 2 | C2 | Scratch images occur on feed of 150,000 sheets | 0.20 |
| 3 | C3 | Scratch images occur on feed of 150,000 sheets | 0.20 |
| 4 | C4 | Scratch images occur on feed of 150,000 sheets | 0.20 |
| 5 | C5 | Scratch images occur on feed of 150,000 sheets | 0.20 |
| 6 | C6 | Scratch images occur on feed of 150,000 sheets | 0.25 |
| 7 | C7 | Scratch images occur on feed of 150,000 sheets | 0.20 |
| 8 | C8 | Scratch images occur on feed of 80,000 sheets | 0.30 |
| 9 | C9 | Scratch images occur on feed of 100,000 sheets | 0.25 |
| 10 | C10 | Scratch images occur on feed of 60,000 sheets | 0.20 |
| 11 | C11 | Scratch images occur on feed of 60,000 sheets | 0.20 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-126552, filed Jun. 2, 2010, and 2011-096915, filed Apr. 25, 2011, which are hereby incorporated by reference herein in their entirety.

What is claimed is:

1. An electrophotographic photosensitive member comprising:

a surface layer containing a polymeric product obtained by polymerizing a composition consisting of an adamantane compound represented by the following general formula (1) and a charge-transporting compound having a chain polymerizable functional group:

(1)

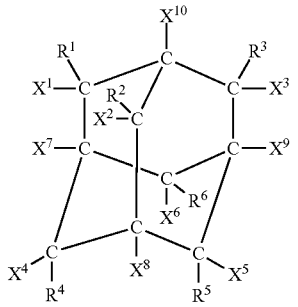

wherein $R^1$ to $R^6$ each independently represent a hydrogen atom, an alkyl group, a haloalkyl group, a hydroxyl group, an alkoxyl group, an amino group, an alkylamino group, a trialkylsilyl group or a halogen atom, and wherein $X^1$ to $X^{10}$ each independently represent a hydrogen atom, an alkyl group, a haloalkyl group, a hydroxyl group, an alkoxyl group, an amino group, an alkylamino group, a trialkylsilyl group, a halogen atom or an organic group having a chain polymerizable functional group, and wherein $R^1$ and $X^1$ may combine to form an oxo group (=O), $R^2$ and $X^2$ may combine to form an oxo group (=O), $R^3$ and $X^3$ may combine to form an oxo group (=O), $R^4$ and $X^4$ may combine to form an oxo group (=O), $R^5$ and $X^5$ may combine to form an oxo group (=O) and $R^6$ and $X^6$ may combine to form an oxo group (=O), provided that at least two of $X^1$ to $X^{10}$ are organic groups having chain polymerizable functional groups, and, when $X^1$ is an organic group having a chain polymerizable functional group, $R^1$ is a hydrogen atom, when $X^2$ is an organic group having a chain polymerizable functional group, $R^2$ is a hydrogen atom, when $X^3$ is an organic group having a chain polymerizable functional group, $R^3$ is a hydrogen atom, when $X^4$ is an organic group having a chain polymerizable functional group, $R^4$ is a hydrogen atom, when $X^5$ is an organic group having a chain polymerizable functional group, $R^5$ is a hydrogen atom, and when $X^6$ is an organic group having a chain polymerizable functional group, $R^6$ is a hydrogen atom.

2. The electrophotographic photosensitive member according to claim 1, wherein $X^1$ to $X^6$ and $R^1$ to $R^6$ are each independently a hydrogen atom or a fluorine atom, $X^7$ to $X^{10}$ are each independently a hydrogen atom, a hydroxyl group, a fluorine atom, or an organic group having a chain polymerizable functional group, and at least two of $X^7$ to $X^{10}$ are organic groups having chain polymerizable functional groups.

3. The electrophotographic photosensitive member according to claim 1, wherein the organic group having a chain polymerizable functional group is a group represented by the following general formula (2):

(2)

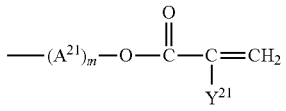

wherein $A^{21}$ represents an alkylene group, m is an integer of 0 or 1, and $Y^{21}$ represents a hydrogen atom or a methyl group.

4. The electrophotographic photosensitive member according to claim 3, wherein the adamantane compound represented by the general formula (1) is an adamantane compound represented by the following general formula (3):

(3)

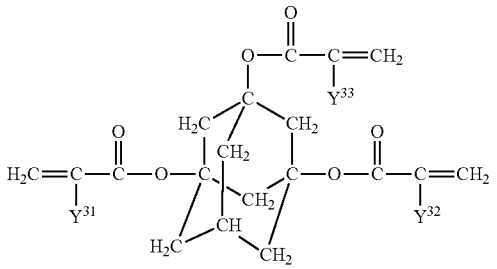

wherein $Y^{31}$ to $Y^{33}$ each independently represent a hydrogen atom or a methyl group.

5. The electrophotographic photosensitive member according to claim 3, wherein the adamantane compound represented by the general formula (1) is an adamantane compound represented by the following general formula (4):

(4)

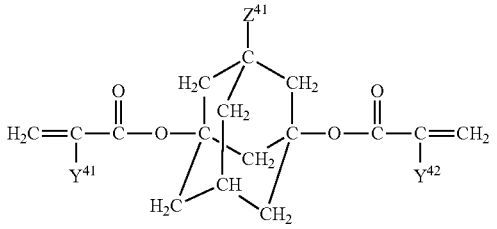

wherein $Y^{41}$ and $Y^{42}$ each independently represent a hydrogen atom or a methyl group, and $Z^{41}$ represents a hydrogen atom or a hydroxyl group.

6. The electrophotographic photosensitive member according to claim 1, wherein the surface layer is a layer of a three-dimensional network structure formed by copolymerizing the compound represented by the general formula (1) with the charge-transporting compound having a chain polymerizable functional group.

7. The electrophotographic photosensitive member according to claim 1, wherein a chain polymerizable functional group of the adamantane compound represented by the general formula (1) and the charge-transporting compound is an acryloyloxyl group.

8. A process of producing the electrophotographic photosensitive member according to claim 1, the process comprising:

a step of forming the above surface layer by irradiating with radiation a coating formed by using a coating solution containing the polymerized composition consisting of the adamantane compound represented by the general formula (1), and the charge-transporting compound having a chain polymerizable functional group, to polymerize the composition.

9. The process of producing the electrophotographic photosensitive member according to claim 8, wherein the radiation is electron rays.

10. A process cartridge comprising the electrophotographic photosensitive member according to claim 1; and at least one means selected from the group consisting of charging means, developing means, transfer means, and cleaning means, which is integrally supported in the cartridge, wherein said process cartridge is detachably mountable to a main body of an electrophotographic apparatus.

11. An electrophotographic apparatus comprising:

the electrophotographic photosensitive member according to claim 1;

charging means for charging a surface of the electrophotographic photosensitive member;

exposure means for exposing the surface of the electrophotographic photosensitive member to exposure light to form an electrostatic image on the electrophotographic photosensitive member;

developing means for developing the electrostratic image on the electrophotographic photosensitive member, using toner held in a developer, into a toner image; and transfer means for transferring the toner image on the electrophotographic photosensitive member to a transfer material.

* * * * *